United States Patent [19]

Nobis

[11] Patent Number: 4,998,695

[45] Date of Patent: Mar. 12, 1991

[54] MULTIPLE ARRANGEABLE STRIP SUPPORT FOR A BAG

[76] Inventor: George Nobis, 3545 Norland Ct., Norfolk, Va. 23513

[21] Appl. No.: 358,077

[22] Filed: May 30, 1989

[51] Int. Cl.[5] ..... B65B 67/04

[52] U.S. Cl. ..... 248/101; 248/311.2

[58] Field of Search ..... 248/95, 97, 99, 100, 248/101, 129, 311.2; 232/43.2; 383/33; 150/49; 141/391, 314, 390; 220/404, 401; 53/390

[56] References Cited

U.S. PATENT DOCUMENTS

| | | | |
|---|---|---|---|
| 3,861,630 | 1/1975 | Ady | 248/100 |
| 4,561,480 | 12/1985 | Underwood | 150/49 |
| 4,664,348 | 5/1987 | Corsaut | 248/99 |
| 4,669,690 | 6/1987 | McEniry | 248/101 |
| 4,765,579 | 8/1988 | Robbins | 220/404 |
| 4,775,123 | 10/1988 | Borland | 248/99 |
| 4,815,866 | 3/1989 | Martone | 141/390 |
| 4,832,291 | 5/1989 | Nelson | 248/99 |

FOREIGN PATENT DOCUMENTS

| | | | |
|---|---|---|---|
| 1256762 | 2/1961 | France | 248/99 |

*Primary Examiner*—J. Franklin Foss

[57] ABSTRACT

A bag support maintaining the mouth of the bag in an open condition while supporting the same. The bag support is optionally provided with a backing support to which the strip can be secured; a retention gasket cooperating with the strip maintaining the bag mouth in an open position and a cover for containing the contents within the bag.

4 Claims, 3 Drawing Sheets

MULTIPLE ARRANGEABLE STRIP SUPPORT FOR A BAG

BACKGROUND OF THE INVENTION

1 FIELD OF INVENTION

The present invention relates to a new and novel support for maintaining the mouth of a plastic bag in open configuration.

2 DESCRIPTION OF THE PRIOR ART

The prior art is well aware of vrious types of strip material utilized for supporting plastic bags and the art is replete with this type of device and can be readily seen by searching the subclasses 95 through 101 of class 248 in the U.S. Patent office.

A simply designed support for maintaining the mouth of a flexible bag or the like in an open position while supporting the same and any contents disposed therein comprised of a main support comprised of a strip of flexible material and optionally including but not necessarily needed, a backing member, a retention strip maintaining the mouth of the bag open, and a cover for the same.

The flexible strip of resilient material is provided with opposing slots at its free ends defining mounting tabs which depending on space considerations and the shape of the support surface, determines the manner in which the strip will be utilized to support a flexible bag or the like with its mouth maintained open for accessibility. The mounting tabs can be placed in an abutting, a spaced, or an opposed relationship to form the strip into a semi-circular shape for supporting a bag thereon by draping the open end thereover. A flexible U-shaped member can be optionally used to secure the mouth of the bag onto the strip. In some instances, the mounting tabs can be secured to a reinforcing backing member to rigidify the same and a cover can be readily mounted thereon to cover the contents of the bag.

BRIEF DESCRIPTION OF THE DRAWINGS

FIG. 5 and 5*a*–5*f* discloses the different variations of mounting the flexible strip to accomodate selected configurations.

DETAILED DESCRIPTION OF THE INVENTION

Figure 1:
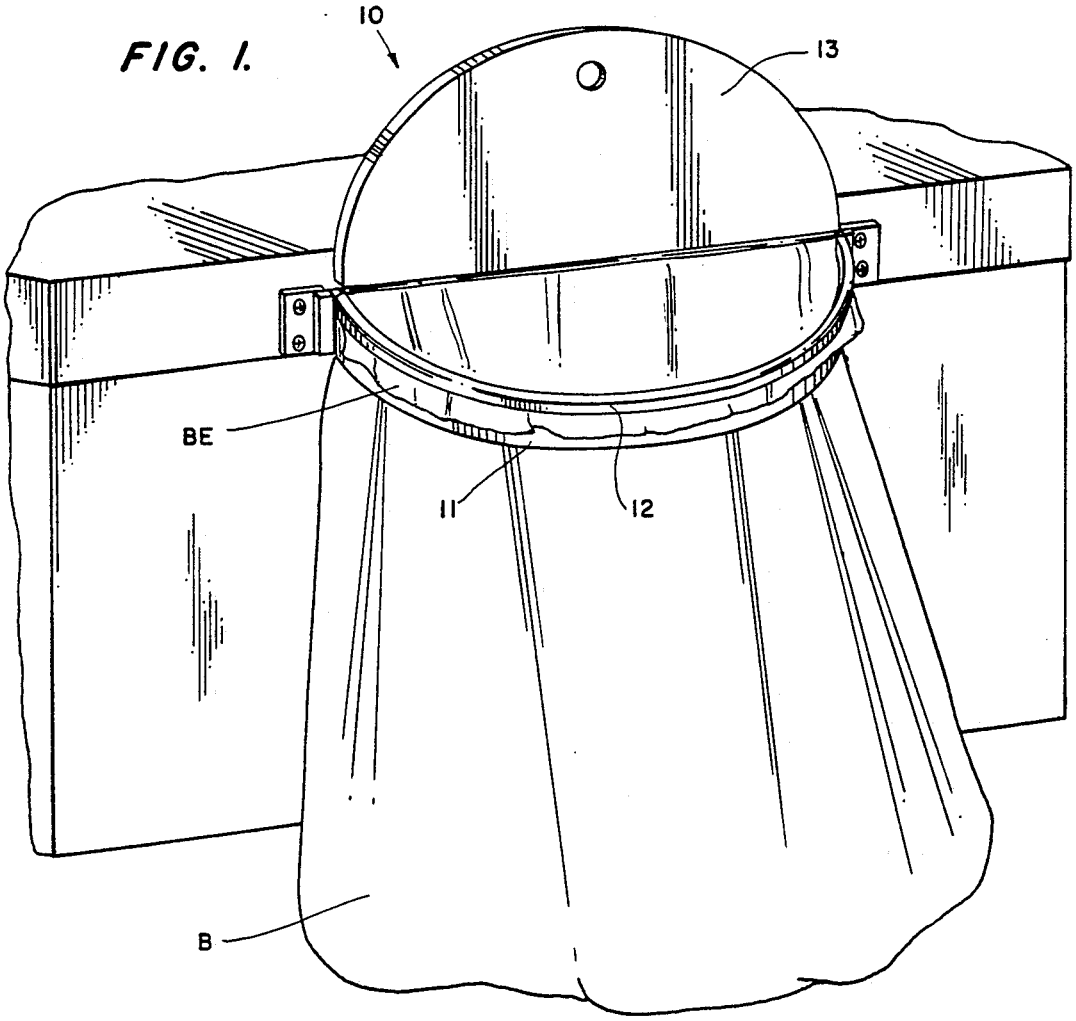
FIGS. 1 and 2 disclose a perspective view of the plastic bag support member with the cover in its open and closed position, respectively.
Figure 2:
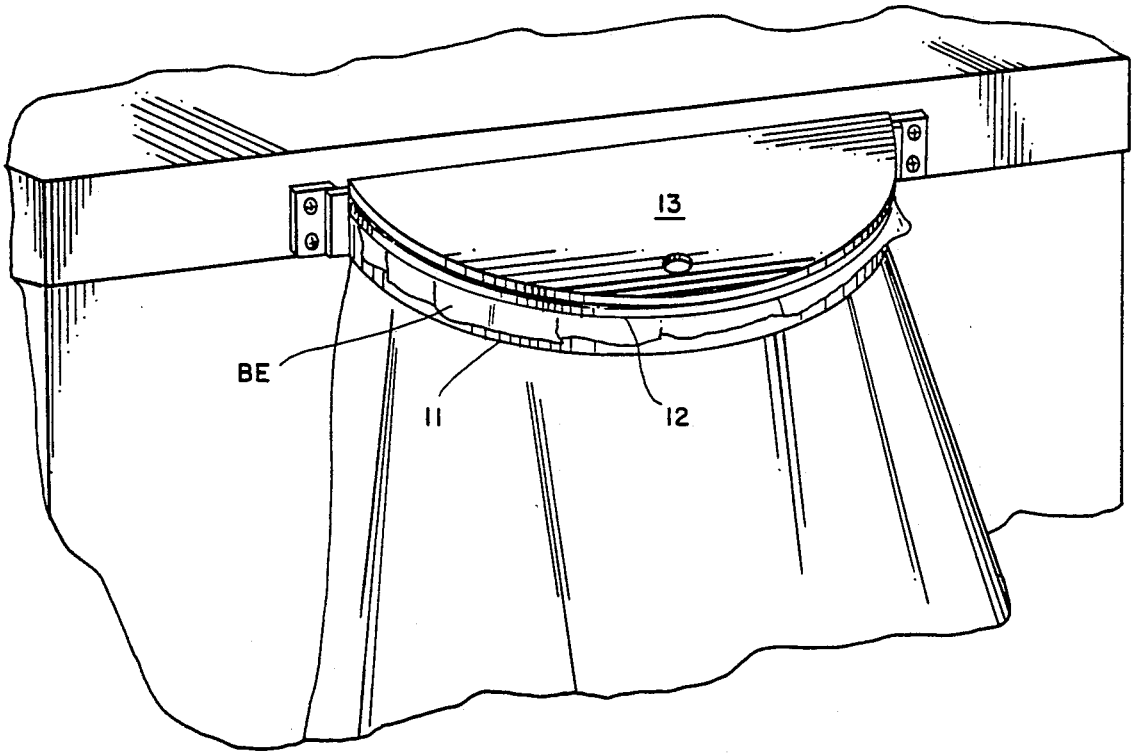

With reference to FIGS. 1 and 2 of the drawings, the bag holder of the present invention is depicted generally by the reference numeral 10 and is seen to include a generally semi-circular main bag support frame 11 and a moldable U-shaped gasket 12 removably disposed about the upper edge of the frame 11. The gasket 12 serves to lock the upper end section BE, of a plastic bag B, in place after it has been draped over the frame 11. The bag holder further includes a cover 13 pivotally disposed above the support frame 11, which serves in its down position, FIG. 2, to contain the refuse and attendant door odor to the confines of the bag or to protect the contents when used for storage purposes. The undersurface of the cover serves as a splashboard protective means.

Figure 3:
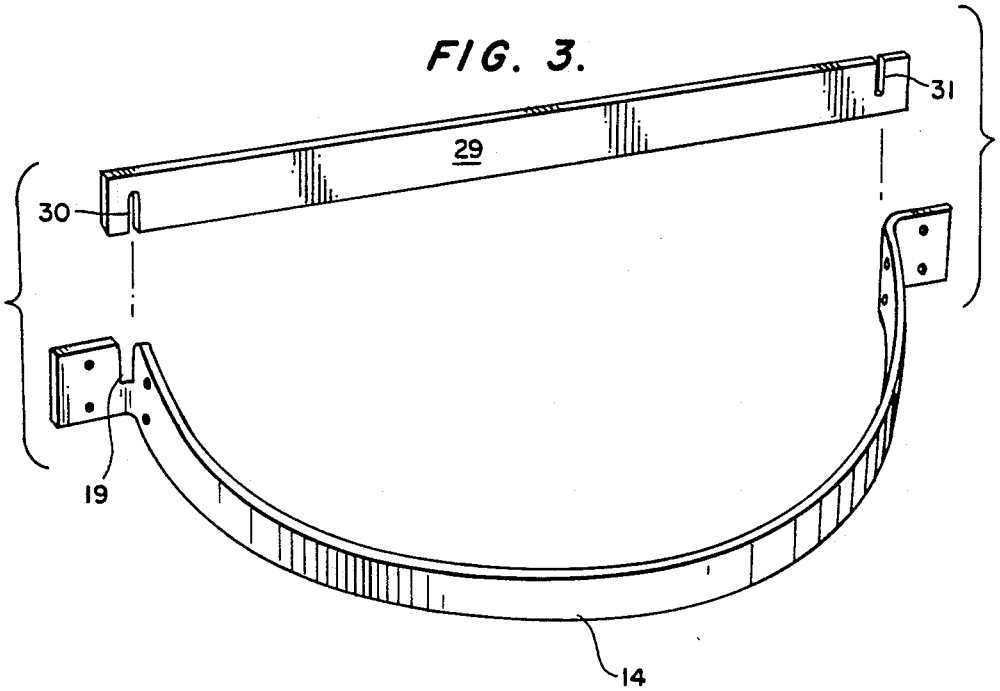
FIG. 3 shows the main supporting strip and backing member of the trash bag holder.

The main support 11 as more clearly seen in FIG. 3 is an strip of flexible plastic 14 having a top and bottom 15, 16, and ends 17, 18. As seen, a pair of slots 19, 20 are disposed inwardly and equal distance from the ends 17, 18 respectively and extends inwardly to the approximate width of the strip 11 whereby the bottoms 21, 22 of the slots 19, 20 terminate in the same common plane thereby leaving a solid portion 23, 24 therebeneath defining a pair of tabs 25, 26. These tabs 25, 26 function to support the strip when the free ends 17, 18 are interengaged or abutted as will be described hereinafter.

Figure 4:
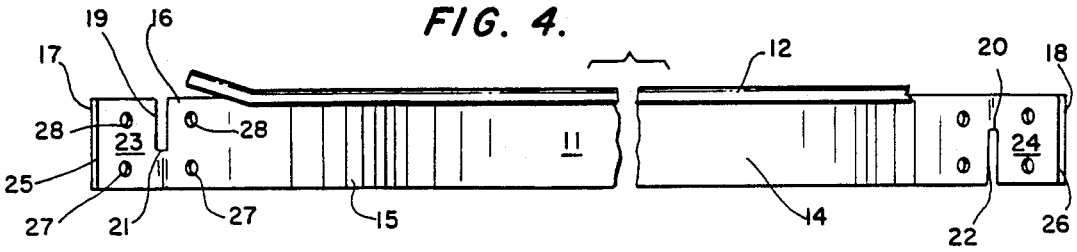
FIG. 4 shows the main supporting strip with the bag holding gasket material in place.
Figure 5A:
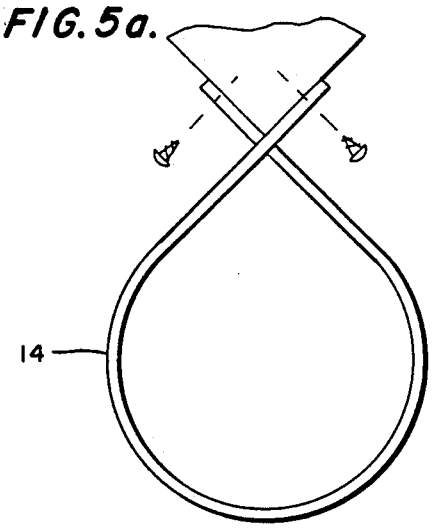
Figure 5B:
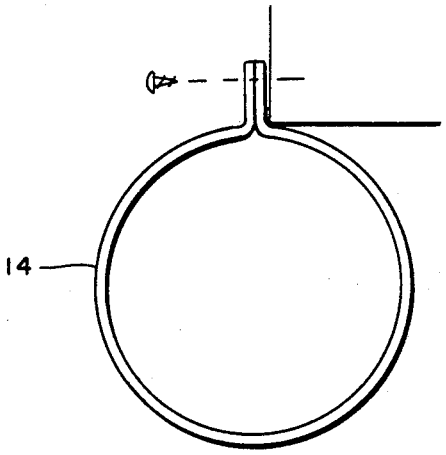
Figure 5C:
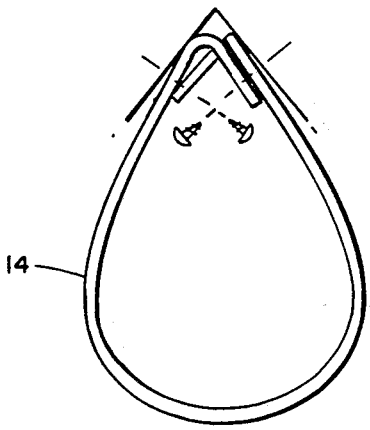
Figure 5D:
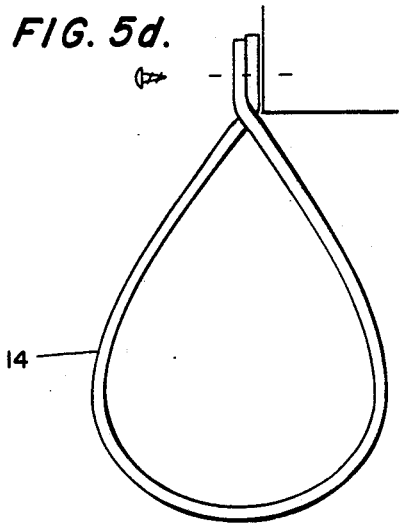
Figure 5E:
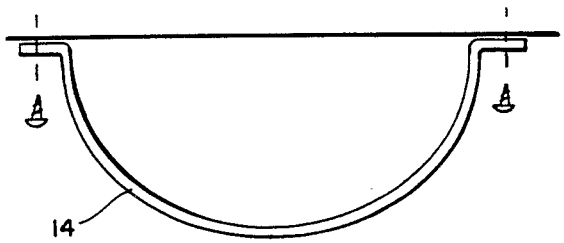
Figure 5F:
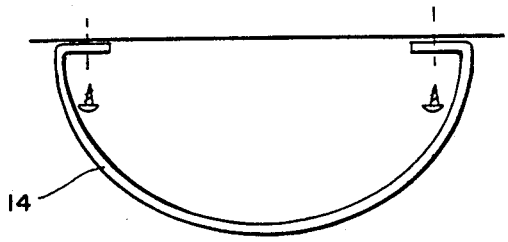

With reference to FIG. 4, strip 11 is seen to be provided with a plurality of spaced holes 27, 27 extending along the bottom 16 thereof and a pair of upper holes or openings 28, 28 positioned on the top edge 15. These pair of holes 28, 28 are in alignment with the pair of holes 27, 27 disposed at the ends of the bottom 16. This, then, permits each tab to be secured to a rectangular support surface by bending the strip 11 in the areas of of the slots 21 and placing any suitable fasteners through the aligned openings to secure the same to maintain the strip in a semi-circular relationship. When one prefers to use the strip 11 as a support for a plastic bag, the user has many available options as to the manner in which the same can be used, which is dependent on space consideration. Since the slots 19, 20 are opposing, the free ends 23, 24 can be interfitted and/or placed in abutting relationship as seen in FIGS. 5*a* to 5*f* and these configurations are attainable and the following is a broad description of the same, at FIG. 5*a* the ends are interengaged to form a somewhat eliptical opening leaving the tabs disposed in a "V" shaped relationship;

FIG. 5 shows the free end overlapped to form a circular configuration with the holes 27, 28 being aligned for fastening purposes;

FIG 5 is similar to FIG. 5*a* but with the tabs squeezed together to form the mounting position;

FIG. 5 shows one tab abutting the other tabs is used solely to mount the same. This is more flexible than when both tabs are placed together and permits the holder to be mounted for flexible movement;

FIG. 5 shows the tabs moved outwardly whereat the same can be secured to a supporting surface; and FIG. 5 shows the support tabs disposed inwardly.

When a bigger bag is to be supported in anticipation of an excess amount of trash or other material being collected, the use of a back supporting piece 29 is utilized in conjunction with the strip 11, and as seen in FIG. 3, is of the same general configuration as strip 11, but smaller in size.

Figure 6:
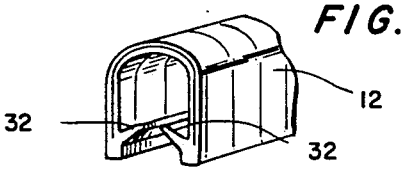
FIG. 6 shows a cross-sectional view of the gasket.

By securing the support member 29 to a wall or the like, the slots 30, 31 are utilized to receive the slots 19, 20 of strip 11 thereby causing same to form the semi-circular configuration of FIGS. 1 and 2. Once the user has determined the preferred shape of strip 11 which is dependent on space consideration, he mounts the same with or without the support member 29 to a vertical surface by placing fasteners through the openings 27, 28. Once the strip has assumed the preferred shape, the user then places a plastic bag B within the same and folds the free ends about the strip 11 to maintain it in an open condition. At this point, and if considered necessary the U-shaped gasket material 12 is then slid atop the upper edge 16 of strip 11 and secures the open end BE of the bag therebetween. This U-shaped gasket material is commercially available and as seen at FIG. 6, has a pair of oppositely directed tangs 32, 32 positioned within the U-shaped member and when the gasket material 12 is pushed over strip 11 the tangs 32, 32 engage the open end of the plastic bag and secure it in place with respect to strip 11.

I claim:

1. A support for a plastic bag comprising an elongated flexible strip, a pair of opposing slots extending inwardly from opposite ends thereof each one of said slots terminating in a same common plane medially of the strip, said location of the slots forming tabs at the end of said strip when the strip is bent at the slots, and at least one opening provided in each tab, said one openings be substantially aligned with each other whereby the tabs can be optionally interengaged, or place in abutting relationship, or used in a separated relationship whereby when fasteners are placed in said at least one opening the strip will assume at least a semi-circular shape to support a plastic bag or the like thereon.

2. The support of claim 1 further including a mounting support of a similar shape and design, means for securing the support to a surface whereby the slots of the strip and that of the support can be interengaged.

3. The support of claim 2 further including a U-shaped gasket member disposed over the upper lip of the strip to maintain a plastic bag in open condition thereon.

4. The support of claim 3 further including a cover pivotally disposed with respect to said strip to cover material in the bag.

* * * * *